US005482280A

United States Patent [19]

Yamawaki

[11] Patent Number: 5,482,280

[45] Date of Patent: Jan. 9, 1996

[54] SET OF GOLF CLUBS

[75] Inventor: Koichi Yamawaki, Chiba, Japan

[73] Assignee: Taylor Made Golf Company, Carlsbad, Calif.

[21] Appl. No.: 372,331

[22] Filed: Jan. 13, 1995

[30] Foreign Application Priority Data

Jan. 14, 1994 [JP] Japan ..... 6-002374

[51] Int. Cl.[6] ..... A63B 53/04

[52] U.S. Cl. ..... 273/167 J; 273/77 A

[58] Field of Search ..... 273/167 R, 167 A, 273/167 C, 167 D, 167 F, 167 G, 169, 173, 174, 175, 77 R, 77 A, 164.1, 167 J

[56] References Cited

U.S. PATENT DOCUMENTS

| | | | |
|---|---|---|---|
| 3,980,301 | 9/1976 | Smith | 273/80 C |
| 3,984,103 | 10/1976 | Nix | 273/77 A |
| 3,985,363 | 10/1976 | Jepson | 273/167 J |
| 4,762,322 | 8/1988 | Molitor | 273/77 A |
| 4,874,171 | 10/1989 | Ezaki | 273/77 A |
| 4,941,666 | 7/1990 | Suganuma | 273/77 A |
| 5,354,054 | 10/1994 | Akatsuka | 273/77 A |

*Primary Examiner*—Sebastiano Passaniti

*Attorney, Agent, or Firm*—Pollock, Vande Sande & Priddy

[57] ABSTRACT

Set of wood-type golf clubs, in which each head (1) comprises at least one lower wall, or sole plate (6), and a hitting wall (4) inclined at an angle of loft (α) in relation to a plane of reference (P). The intersection of the walls (4) and (6) forms a leading edge (7) having a radius (R), and this radius (R) increases as the angle of loft (α) increases.

7 Claims, 5 Drawing Sheets

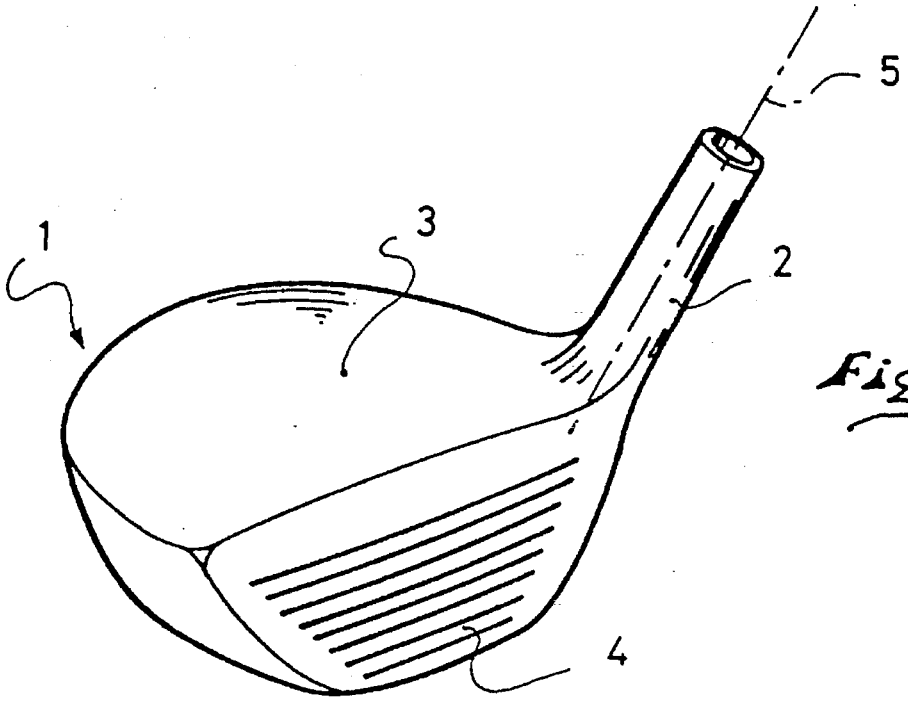
Fig: 1
Fig: 2
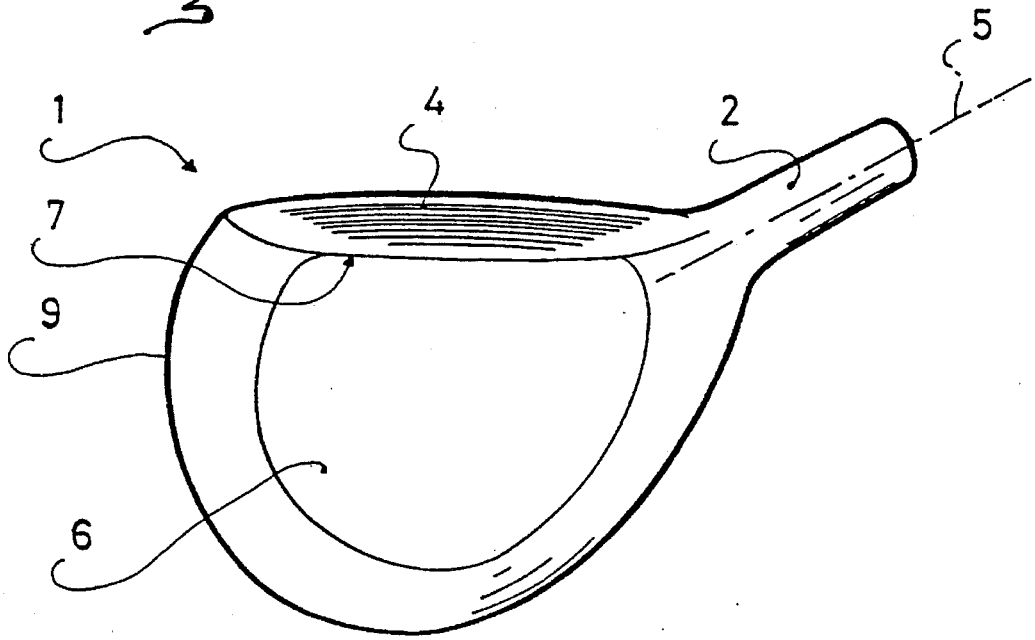

SET OF GOLF CLUBS

FIELD OF THE INVENTION

The present invention concerns the field of golf clubs used for the sport of golf.

More particularly, the invention relates to a set of golf clubs of which each head comprises, in particular, at least one front wall used to strike the ball and a lower wall.

More particularly still, the invention concerns a set of driver-type golf clubs, certain characteristics of which change within the set.

BACKGROUND OF THE INVENTION

A driver is a golf club used to hit the first stroke from the tee. The tee has a well-defined, fixed configuration through which each golfer must necessarily pass. However, the golfer's game and capabilities evolve over time. As a result, in the vast majority of cases, the same golfer will not hit the ball twice in an identical manner using the same driver from the same tee. Accordingly, variations which are sometimes appreciable occur in the golfer's performance.

To compensate for these differences in performance, the golfer selects, within a set, the driver which appears to him to be the most suitable, taking into account the inclination of the hitting face of the club head in relation to a reference plane delineated by a so-called "angle of loft."

The golfer will prefer the choice of a driver having fairly slight loft if he feels fit and has confidence in his game. In the contrary case, the golfer will look for a driver having fairly pronounced loft, which gives him more confidence since it facilitates the lift of the ball.

Differences in performance also occur among golfers of differing abilities.

Reduced loft is normally prized by good golfers, while greater loft meets the expectations of more ordinary players.

Generally speaking, there is a close correlation between a golfer's performance and his self-confidence. It has been demonstrated that this confidence is enhanced if the club proves stable when addressing the ball, i.e., when the head rests on the ground before the ball is struck. At this precise moment, the golfer positions the club before raising it in order to execute the hitting motion.

It has already been shown that confidence correlates with the surface area of the sweet spot, that is, with the ideal hitting area located on the front face of a club head. Confidence increases in proportion as the surface area of the sweet spot increases, because, in this case, club tolerance is greater. In fact, even if the stroke is not aimed perfectly, the gap between the true and the optimal impact of the ball on the hitting face does not cause the path to deviate a great deal. A golfer lacking confidence or of modest ability will thus choose a head incorporating a large sweet spot.

On the other hand, when the golfer is confident or plays at a high level, he will choose a small sweet spot, in order to facilitate the proper configuration and accuracy of the trajectory, even if, in this case, the tolerance is reduced.

It thus becomes important to be able to choose, from a set of clubs each having a different loft, and in particular from a set of drivers, a club whose stability when addressing the ball and the size of whose sweet spot are proportional to the loft.

However, under present circumstances, there is no set of woods or drivers in which the size of the sweet spot and the stability of the head resting on the ground before impact with the ball are a function of the angle of loft selected.

SUMMARY OF THE INVENTION

To solve this problem, a set of woods according to the invention, in which each club comprises a shaft falling within a vertical plane P extending perpendicularly to a hitting line T and on which is fitted a head incorporating a series of walls, of which at least one lower wall, or sole plate, designed to rest on the ground and at least one inclined front wall incorporating a value of the angle of loft $\alpha$ formed with the plane P, the intersection of the sole plate and the front wall forming a curved leading edge embodying at least one portion of an arc tangent to the ground and having a radius R, is characterized by the fact that the radius R of this portion increases as the angle of loft $\alpha$ increases in this set.

One advantage associated with this radius, which varies in relation to the angle of loft, lies in that fact that this set allows a medium-level player to make choices which will enable him to play better.

Another advantage resulting from the features according to the invention enables an advanced player, or an average but confident player, to execute his strokes better, so as to adjust to the specific characteristics of the course.

An advantage deriving from the two preceding ones lies in the fact that the set of clubs is intended for all levels of players, whether beginners or experienced golfers. Accordingly, the purchase of equipment becomes less costly, since the beginner who makes progress will not be obliged to replace the set.

BRIEF DESCRIPTION OF THE DRAWINGS

Other features and advantages of the invention will emerge from the following description provided with reference to the attached drawings, in which:

FIG. 1 is a perspective view of a conventional head;

FIG. 2 is a perspective view of a head similar to that in FIG. 1, but at another angle;

DETAILED DESCRIPTION

Figure 3:
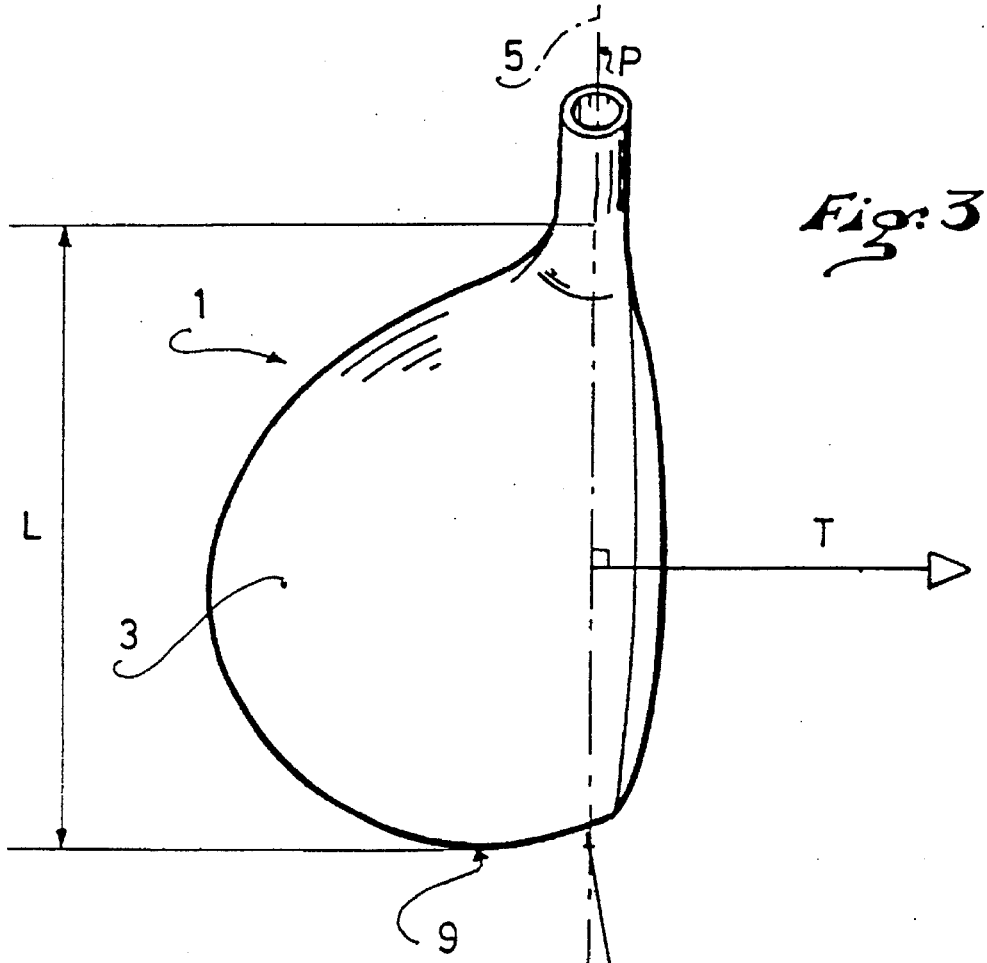
FIG. 3 is a top view of a golf club head illustrating a vertical plane of reference and a hitting line.

FIG. 1 shows a head 1 forming one piece with a shaft-fitting area 2 and incorporating, most notably, a top wall 3 and a hitting wall 4. The shaft-fitting area 2 extends along an axis 5.

FIG. 2 also represents the head 1, but at a different angle, and illustrates a bottom wall 6 of the head, termed the lower wall or sole plate, as well as a leading edge 7 formed at the intersection of the sole plate 6 and the front wall 4.

The wall 6 is a conventional one and resembles a shell with rounded contours.

The identification of these several components of the head allows delineation of a plane and a line of reference, as illustrated for example in FIG. 3. A vertical plane P, which contains the axis 5 of the rectilinear shaft of the club, is perpendicular to a hitting line T. This hitting line T is an imaginary horizontal line which passes through the geometric center of the hitting wall 4 and extends toward the imaginary vertical axis of the targeted hole.

The plane P and the line T give the ideal position of the head when the golfer brings the club forward before hitting the ball. Under these conditions, it is possible to define an angle, termed the "angle of loft," as illustrated in FIG. 4

The angle of loft is the angle formed between the plane P as delineated above and a straight line located in a vertical plane and tangent to the geometric center of the wall 4. The customary values of the angle of loft of wood-type club heads range from 7 to 15 degrees.

Other references will permit better understanding of the invention.

Figure 4:
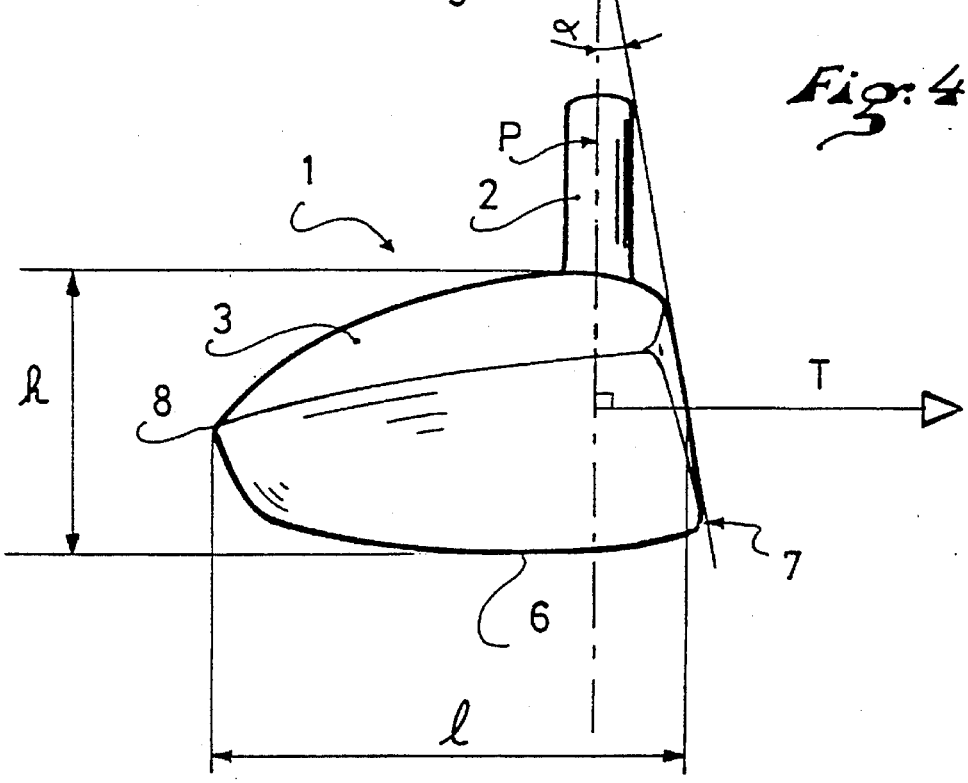
FIG. 4 is a side view of a golf club head illustrating the angle of loft.

The letter "1" designates the width of the head, as illustrated in FIG. 4. This width 1 is the distance between two vertical planes parallel to plane P, one having a point shared with the rear extremity 8 of the head 1, and the other passing through the geometric center of the hitting wall 4.

Figure 5:
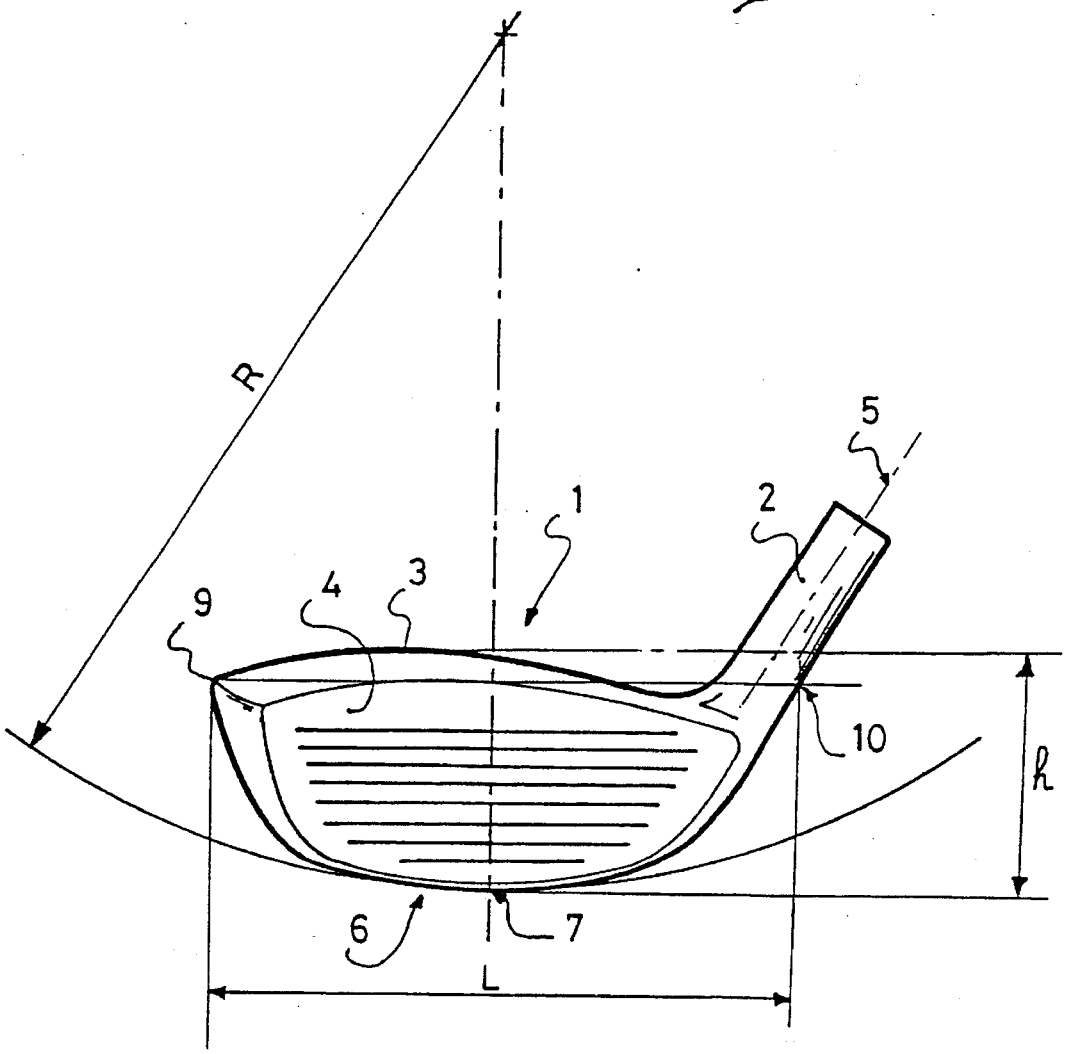
FIG. 5 is a front view of a golf club head showing the hitting wall and illustrating the radius of the leading edge.

The letter "L" designates the length of the head as shown, for example, in FIG. 5. This length L is the distance between two vertical planes perpendicular to plane P, one having a point shared with the lateral end 9 of the head 1 located on the side opposite the handle-fitting area 2 of the club, and the other encompassing the imaginary point of intersection 10 of the shaft-fitting area 2 and an imaginary horizontal plane passing through the end 9. This point of intersection 10 is the most distant from this end 9.

The letter "h" designates the height of the head as illustrated, for example, in FIG. 5. This height h is the distance between two horizontal planes, one tangent to the top wall 3 of the head 1, and the other tangent to the sole plate 6 of the head 1.

Figure 6:
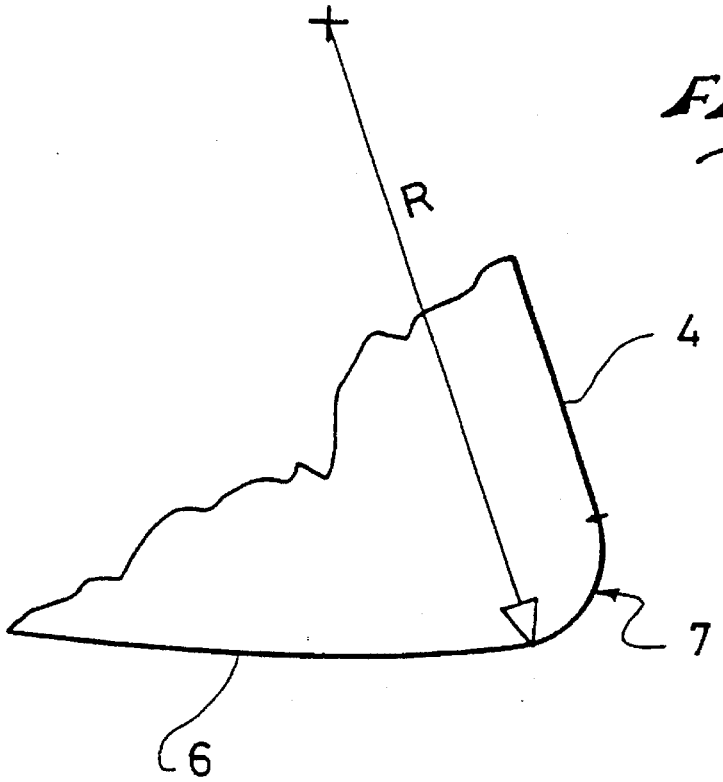
FIG. 6 is a diagram illustrating a connection element, in the form of an arc of a circle, joining the sole plate and the hitting face of a head.
Figure 7:
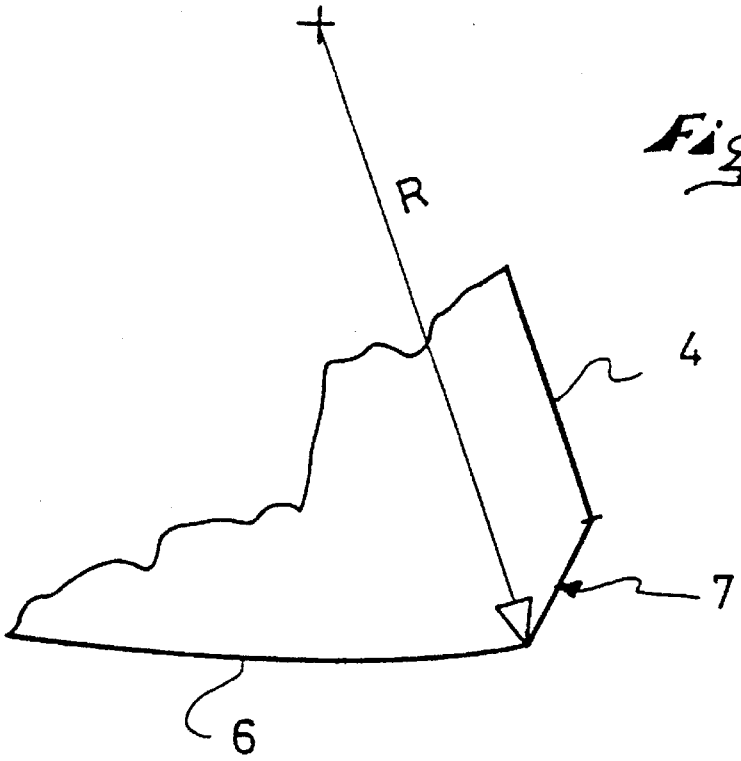
FIG. 7 is a diagram illustrating a connection element in the form of a straight line segment or chamfer between the sole plate and the hitting face of a head.

Finally, the radius R, which is also illustrated in FIG. 5, is a radius of the curved lead edge 7, which includes at least one portion of an arc tangent to the ground when the head is in the hitting position. This radius R is measured at the front end of the sole plate 6, that is, on the side of the hitting face. FIGS. 6 and 7 illustrate, as non-limiting examples, two geometric shapes used to connect the faces 4 and 6 so as to form the leading edge 7.

FIG. 6 represents an arc of a circle connecting the faces. In this case, the radius R is measured at the intersection of the sole plate 6 and of the connecting arc.

FIG. 7 shows a chamfer connecting these faces. In this case, the radius R is measured at the intersection of the sole plate 6 and of the flat portion of the chamfer.

According to the invention, the radius R of the portion of the leading edge 7 tangent to the ground increases as the loft increases in the set of woods or drivers.

Low loft is used by the golfer who wishes to impart high speed to the ball without making it rise very high. In this case, the radius R, which is also small, advantageously makes it possible to reduce the surface area of the sweet spot, or area of impact with the ball. One advantage gained by a small sweet spot affects good or confident players, since it allows them to play with greater accuracy, because the low tolerance helps to better analyze the causes of the changed behavior of the ball.

A higher loft is used by the unsure player, or by the advanced player who wants to hit the ball while taking into account a specific point, such as an obstacle. In this case, the player attempts to lift the ball. The fairly large radius R promotes stability when addressing the ball and increases the impact area formed by the hitting face 4. Consequently, a head incorporating a high loft and large radius R compensates for a divergence of position of the head in relation to the ball at the moment of impact.

Figure 8:
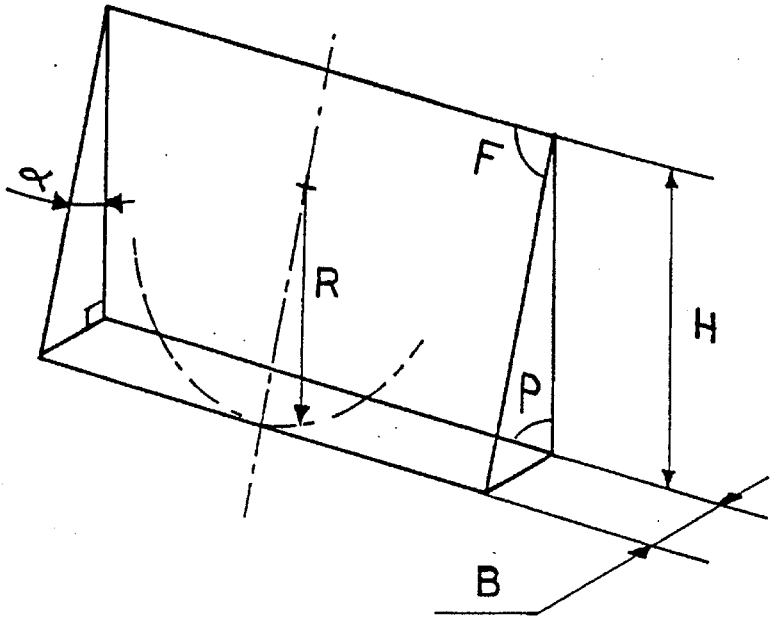
FIG. 8 is a diagram which relates a small angle of angle to a small radius.
Figure 9:
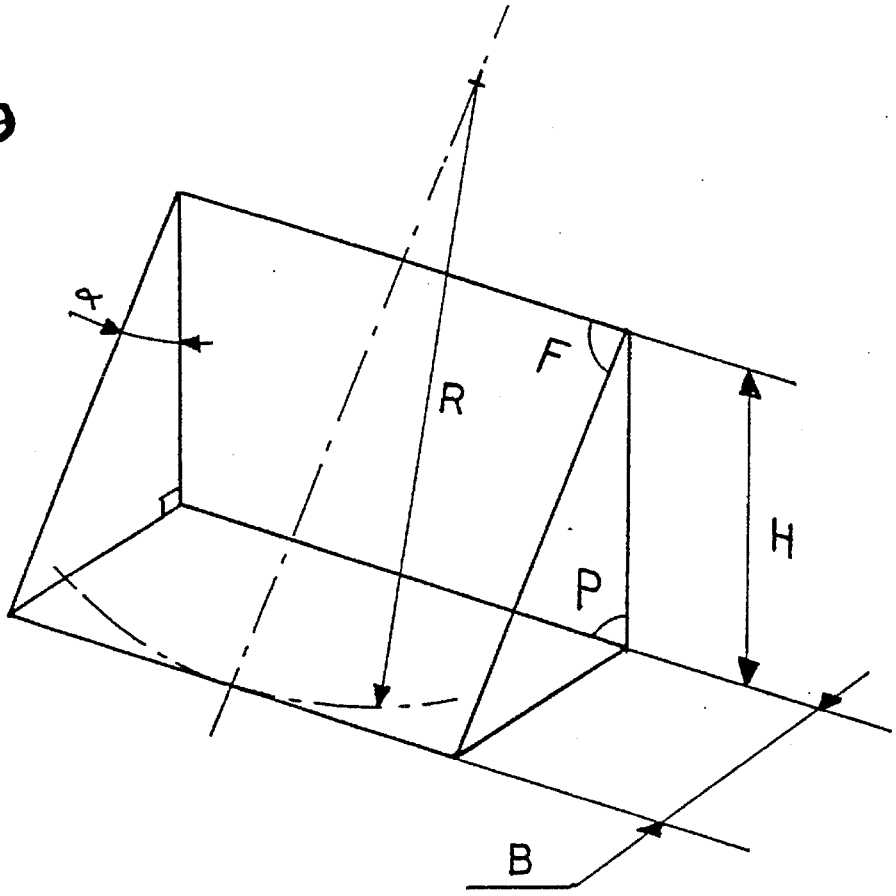
FIG. 9 is a diagram which relates a large angle of loft to a large radius.

FIGS. 8 and 9 symbolize the values of the angle of loft and of the radius R.

In each of FIGS. 8 and 9, a prism having the same height H incorporates two main faces, one vertical, which symbolizes the plane P, and the other marked F, which slopes at an angular value α in relation to plane P. The face F represents the plane tangent to the center of the hitting face 4.

FIG. 8 corresponds to a small angle of loft α and radius R. The base B of the prism is smaller than in the case of FIG. 9, in which the angle of loft α and the radius R are larger.

Several radius values are given in relation to the angle of loft as non-limiting examples.

| | | | |
|---|---|---|---|
| Angle of loft in degrees | 9 | 10 | 11.5 |
| Radius in millimeters | 63.5 | 76.2 | 88.9 |

Other characteristics improve still further the performance and confidence of the player.

Accordingly, a set of golf clubs according to the invention is produced in such a way that the width 1 of the head increases in the set as the angle of loft α increases.

One advantage of this characteristic lies in the ability to distribute the material increasingly toward the rear of the head as the loft increases. Indeed, weight located near the rear extremity 8 improves the lift of the ball because of the centrifugal force which increases shaft flection, and, consequently, the inclination of the head, during the hitting motion. Everything occurs as though the angle of loft α has increased slightly. This phenomenon is generally called "dynamic loft."

Another advantage lies in the increased confidence of the golfer, because the appearance of a larger head reassures him.

Moreover, a set of golf clubs according to the invention is produced so that the length L of the head increases in the set as the angle of loft α increases. In this case, one important advantage resides in the distribution of material toward the lateral ends of the head. The result is improved rotational head inertia in relation to a vertical axis of plan P, which contains a point belonging to the hitting line T, both during the hitting motion and upon impact with the ball, thereby increasing club tolerance and reducing deviations of the trajectory.

An additional advantage lies in the increased confidence of the player, by virtue of the fact that he gains reassurance from a larger head.

As an example, several values of head width and length are given as a function of the angle of loft:

| | | | |
|---|---|---|---|
| Angle of loft in degrees | 9 | 10 | 11.5 |
| Length of the head in | 100 | 102 | 105 |

-continued

| | | | |
|---|---|---|---|
| millimeters | | | |
| Width of the head in millimeters | 76.5 | 78.6 | 81 |

Another parameter, i.e., the height of the head h, can vary within the set. If the head 1 is made of a light material, such as plastic, a composite material, or an assembly of fibers and resin, the weight saved through the use of this material advantageously makes it possible to increase the height h when the loft increases.

Thus, a series of golf clubs according to the invention, in which the heads are made of plastic or composite materials or of fibers and resin, is such that the height h of the head 1 increases in the set as the angle of loft increases.

Another feature lies in increasing the hitting surface area 4 and in furnishing greater hitting tolerance.

Still another feature is that, since the head is light, it is possible to make it heavier using one or several weights preferably placed at the rear and/or lateral ends. The golfer thus can adjust or select a set of clubs which he finds suitable.

Finally, a sizable height h of the hitting face has the advantage of reassuring the player, who will be still more confident.

Now, if the head is made of a relatively heavy material, such as a metal, e.g., aluminum or steel, or an alloy produced using powder metallurgy, e.g., a silicon carbide, increasing the height h produces an excessive increase of the weight of the head if the width 1 and length L are too large. In this case, a series of golf clubs according to the invention, in which the heads are made of metal or metal compounds, is manufactured so that the height h of the head decreases in the set as the angle of loft α increases.

One advantage of this arrangement derives from the fact that it is possible to retain sizable head lengths and widths if the material of manufacture is a metal.

Furthermore, one embodiment of the invention involves the manufacture of a set of golf clubs in which the height h of the head decreases when the width 1, length L, radius R, and angle of loft α increase. In this case, advantage lies on producing a head having good dynamic loft, good rotational inertia, and an appearance which inspires confidence in the golfer.

With respect to a set of drivers, the head height decreases in the set as the width 1, length L, radius R, and angle of loft increase.

If, for example, this set includes three drivers having lofts of 9, 10, and 11.5 degrees, one golfer selects a driver among the three, but each of three golfers can choose the most suitable driver for himself/herself.

The heads are manufactured using any conventional method known to the specialist, such as lost wax molding, chilled cast iron, or assembly by welding the various metal walls.

What is claimed is:

1. Set of wood-type golf clubs, in which each club comprises a shaft extending in a vertical plane (P) perpendicular to a hitting line (T), and on which is mounted a head (1) incorporating a series of walls, including a sole plate (6), designed to rest on the ground and at least one front inclined wall (4) having an angle of loft (α) value in relation to the plane (P), the intersection of said sole plate (6) and of said front wall (4) constituting a curved leading edge (7) incorporating at least one portion of an arc tangent to the ground and having a radius (R), wherein said radius (R) of said portion increases as said angle of loft (α) increases in the set.

2. Set of golf clubs according to claim 1, wherein a width (1) of the head increases in said set as the angle of loft (α) increases.

3. Set of golf clubs according to claim 1, wherein a length (L) of the head increases as the angle of loft (α) increases.

4. Set of golf clubs according to claim 1, wherein said heads are made of plastic or composite materials, and wherein a height (h) of the head increases in said set as the angle of loft (α) increases.

5. Set of golf clubs according to claim 1, wherein the heads are made of metal or metal compounds, and wherein a height (h) of the head decreases in said set as the angle of loft (α) increases.

6. Set of golf clubs according to claim 1, wherein the height (h) of the head decreases in said set as a width (1), length (L), radius (R), and angle of loft (α) increase.

7. Set of clubs composed of drivers, wherein each driver includes a club head comprising a series of walls and includes a toe, heel and top surface, a rear extremity and further including at least a sole plate designed to rest on the ground and at least one front inclined wall having a loft angle (α), wherein each said driver has a width (1) extending from a plane containing the front wall to said rear extremity, a length (L) extending substantially from said heel to said toe and a height extending from said sole to said top surface, wherein the height (h) of each said head decreases in said set as the width (1), the length (L), the radius (R) and the loft angle (α) increases.

* * * * *